US005095807A

United States Patent [19]

Wagenseil

[11] Patent Number: 5,095,807

[45] Date of Patent: Mar. 17, 1992

[54] AXIAL PISTON MACHINE OF THE SWASHPLATE TYPE WITH RADIAL MOTION OF TILT AXIS

[75] Inventor: Ludwig Wagenseil, Vohringen, Fed. Rep. of Germany

[73] Assignee: Hydromatik GmbH, Fed. Rep. of Germany

[21] Appl. No.: 627,724

[22] Filed: Dec. 14, 1990

[30] Foreign Application Priority Data

Dec. 20, 1989 [DE] Fed. Rep. of Germany ..... 3942189

[51] Int. Cl.[5] ..... F01B 3/00; F01B 13/04; F04B 1/26

[52] U.S. Cl. ..... 92/12.2; 91/505; 74/60; 417/222 R

[58] Field of Search ..... 91/505, 506; 92/57, 92/12.2; 74/60; 417/222 R

[56] References Cited

U.S. PATENT DOCUMENTS

| | | | |
|---|---|---|---|
| 4,077,269 | 3/1978 | Hodgkinson | 74/60 |
| 4,168,632 | 9/1979 | Fokker | 91/505 X |
| 4,433,596 | 2/1984 | Scalzo | 91/505 X |
| 4,581,980 | 4/1986 | Berthold | 91/506 X |
| 4,683,804 | 8/1987 | Futamura et al. . | |
| 4,934,253 | 6/1990 | Berthold et al. | 91/506 |
| 4,973,229 | 11/1990 | Oono et al. | 417/222 R |
| 5,000,667 | 3/1991 | Taguchi et al. | 91/505 X |

FOREIGN PATENT DOCUMENTS

| | | | |
|---|---|---|---|
| 3733083 | 4/1989 | Fed. Rep. of Germany . | |
| 3743125 | 7/1989 | Fed. Rep. of Germany . | |
| 2104175 | 3/1983 | United Kingdom | 74/60 |

*Primary Examiner*—Edward K. Look
*Assistant Examiner*—John Ryznic
*Attorney, Agent, or Firm*—Scully, Scott, Murphy & Presser

[57] ABSTRACT

The invention relates to an axial piston machine of the swashplate type in which the drive shaft passes through the swash plate, the swash plate can be tilted about an effective tilt axis so that its working surface supporting the pistons has a radial component of motion relative to the drive shaft as it is tilted in the direction of which the effective tilt axis is displaced parallel as the swashplate is tilted. In order to adjust the swashplate to a larger tilt angle, according to the invention the effective tilt axis is adjusted radially in a direction opposite to the direction of the radial component of motion (R) of the swashplate working surface.

23 Claims, 4 Drawing Sheets

AXIAL PISTON MACHINE OF THE SWASHPLATE TYPE WITH RADIAL MOTION OF TILT AXIS

TECHNICAL FIELD OF THE INVENTION

The invention relates to an axial piston machine of the swashplate type.

BACKGROUND OF THE INVENTION AND PRIOR ART

An axial piston machine of this kind is known from DE-OS 37 33 083, in which the swashplate is supported eccentrically to the axis of the drive shaft so that it can tilt on the housing by means of a swivel bearing. The swivel bearing comprises supporting surfaces on the housing that are radial relative to the drive shaft and, bearing against these, convex projections on the rear side of the swashplate, i.e. the side opposite the working surface that supports the pistons. The contact surfaces between the convex projections and the supporting surfaces on the housing define the effective tilt axis about which the swashplate can be tilted. Because the swivel bearing is located eccentrically of the drive shaft axis and at a distance from the working surface of the swashplate corresponding to the thickness of the swashplate, when the swashplate is tilted the motion of the working surface has a radial component directed so as to reduce the distance between the drive shaft and the inner rim of the part of the swashplate that is being raised from the housing support surfaces. The theoretical maximum tilt angle is obtained when this reduction in distance is 0. In the known axial piston machines, however, this reduction in distance is greater than the amount of the said radial component of motion by the amount of a further radial component of motion in the same direction which results from the fact that as the swashplate is being tilted the convex projections roll on the bearing surfaces of the housing in the direction of the axis of the drive shaft in order to avoid sliding friction, and the effective tilt axis is consequently moved in the same direction. Accordingly the maximum tilt angle actually obtainable is smaller than that corresponding to the position of the swivel bearing relative to the drive shaft axis and to the swashplate working surface.

OBJECT OF THE INVENTION

It is an object of the invention to further develop an axial piston machine of the kind mentioned in the introduction so that the swashplate can be adjusted to larger tilt angles.

SUMMARY OF THE INVENTION

This object is achieved by making the effective tilt axis radially adjustable in a direction opposite to the radial component of motion of the swashplate working surface. In this way, the inner swashplate rim that approaches or more closely approaches the drive shaft during tilting is moved away from the drive shaft by an amount depending on the extent of the radial adjustment of the effective tilt axis. This movement is translated directly into an increase in the tilt angle. The reduction in distance can be entirely eliminated or even changed into an increase in distance. With the solution according to the invention tilt angles larger than 20° can be set while utilising the entire passage bore of the swashplate through which the drive shaft passes, i.e. without increasing the bore and thus without loss in strength.

The solution according to the invention can be applied to all axial piston machines of the swashplate type, i.e. to machines whose swashplates are mounted on bearings outside the plane of their working surfaces, either centrally or eccentrically of the axis of the drive shaft, and on bearings in the plane of their working surface eccentrically of the axis of the drive shaft. In the latter case, when the swashplate is tilted, two mutually opposed sections of the inner rim of the swashplate, intersected by a straight line perpendicular to the effective tilt axis, approach the tilt axis, the section further from the tilt axis moving to a greater extent than the nearer one. In this case the radial adjustment of the effective tilt axis takes place counter to the sense of the radial component of motion of the section spaced further from the effective tilt axis. The solution according to the invention can also be used in axial piston machines in which the swashplate can be tilted in both directions, i.e. from $-V$ to $+V$.

According to an advantageous further development of the invention, the effective tilt axis can be adjusted radially simultaneously with, and preferably by, the tilting of the swashplate. This enables tilting of the swashplate to be performed quickly and simply.

It is advantageous if the swashplate is supported so that it can tilt on the housing of the axial piston machine by way of swivel bearing means defining the effective tilt axis, the swivel bearing means being guided so that it can be displaced radially in guide means on the housing extending in the direction of the radial components of motion of the swashplate working surface. These guide means may comprise two mutually spaced guideways and the swivel bearing means may comprise two pivot hemispheres, each guided in one of the respective guideways, with two half-shells formed on the swashplate mounted thereon.

The swashplate is advantageously rotatably guided by means of two respective journals parallel to the effective tilt axis, in two restraining guideways formed on opposed parts of the housing, each running in a respective plane perpendicular to the effective tilt axis, and extending so that when the swashplate is tilted they constrain the swivel bearing means to move along the guideway in a sense opposite to that of the radial components of motion of the swashplate working surface.

According to a further development of the invention the effective tilt axis is outside the plane of the swashplate working surface, and can intersect the axis of the drive shaft when the swashplate is in the zero position. In addition the axis of rotation of the journals can intersect the axis of the drive shaft when the swashplate is in the zero position so that if the restraining guideways extend parallel to the drive shaft axis the swashplate can be tilted in both possible directions, i.e. both clockwise and counter-clockwise, with the radial adjustment of the effective tilt axis according to the invention.

To tilt the swashplate into a preferred direction it is advantageous if the axis of rotation is arranged to one side of the drive shaft axis when the swashplate is in the zero position, and/or if the restraining guideways run at a guidance angle inclined to the drive shaft axis, preferably in the direction of the effective tilt axis in the swashplate zero position. The guidance angle can be substantially equal to the tilt angle of the completely tilted-out swashplate.

According to another further embodiment of the invention, in the swashplate zero position the effective tilt axis is arranged to one side of the drive shaft axis. This has the further result that it is possible to tilt the swashplate preferentially in one of the two directions, for example under the influence of the hydraulic piston force.

Each journal is advantageously mounted in a sliding block guided in the respective restraining guideway.

According to a further development of the invention the swivel bearing arrangement is mounted in the guideway with hydrostatic support. For this purpose it is advantageous if at least one through-passage through each pivot hemisphere connects a groove in its flat sliding surface with a groove in its spherical sliding surface. At least one transverse passage can be provided in each pivot hemisphere which connects a further groove formed in the respective spherical sliding surface to the through-passage.

For supplying lubricating oil to the grooves in the flat sliding surfaces of the pivot hemispheres, a lubricating oil line is advantageously provided in the housing leading into each of the guideways. The lubricating oil can also be supplied via a longitudinal bore in the adjusting device and transverse bores in the swashplate connected thereto, with one of the transverse bores leading into each of the grooves in the spherical sliding surfaces of the pivot hemispheres. Lubricating oil is preferably supplied intermittently from the cylinder bores by way of a respective axial bore running through each of the pistons, their spherical heads and the slippers and of a respective through-passage in the swashplate leading to the pivot hemispheres, these bores leading at one end into the half-shells in the region of the grooves and at the other end to the swashplate working surface on the slipper path.

BRIEF DESCRIPTION OF THE DRAWINGS

The invention will now be described in more detail with reference to a preferred exemplary embodiment shown in the drawings, in which.

DETAILED DESCRIPTION OF A PREFERRED EMBODIMENT OF THE INVENTION

Figure 1:
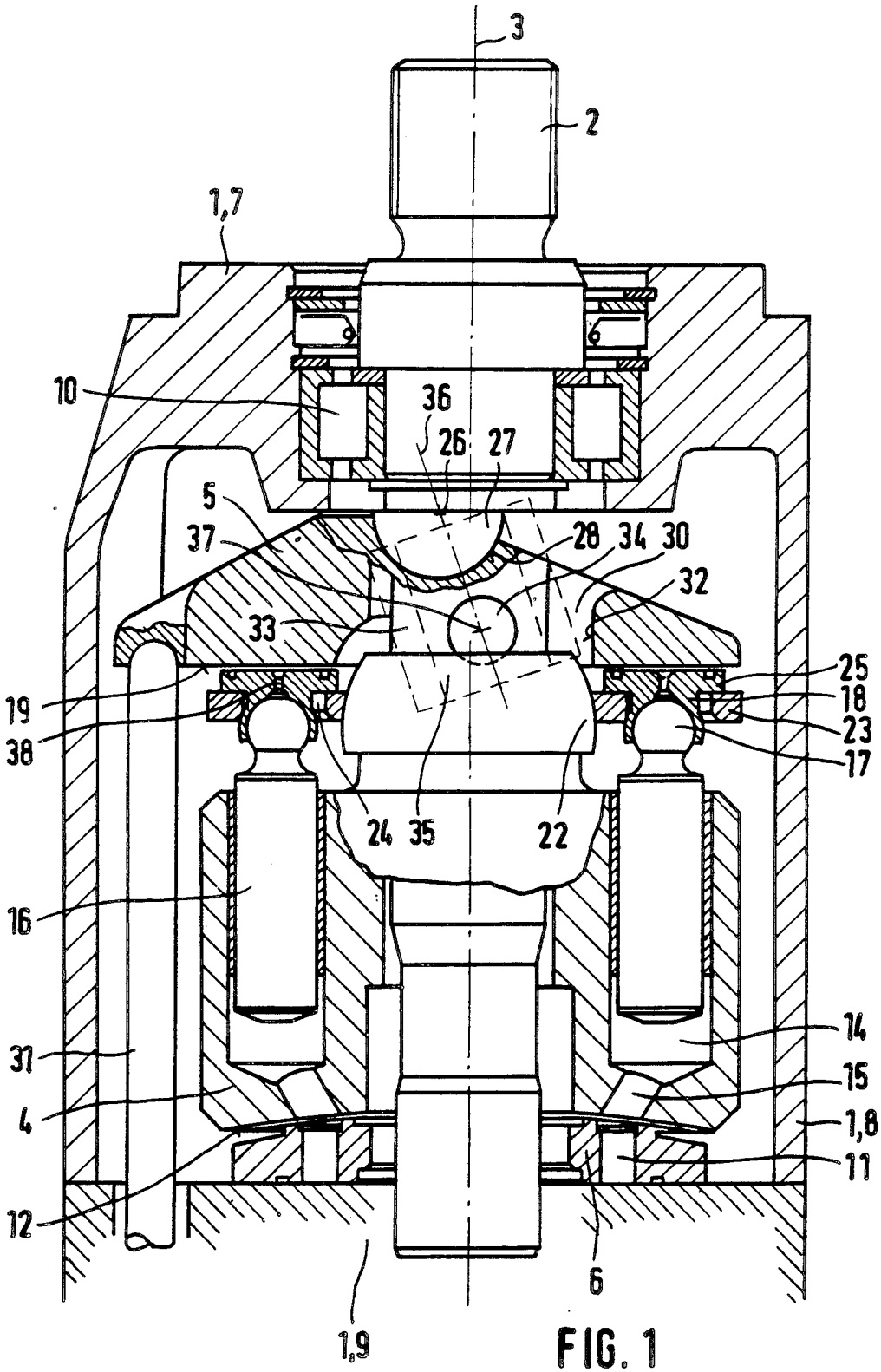
FIG. 1 is a longitudinal section through the preferred exemplary embodiment of the axial piston machine of the invention, with a swashplate in the zero position.

The axial piston machine shown in the drawings comprises a pot-shaped housing 1, a drive shaft 2 with a drive shaft axis 3, a cylinder block 4, a swashplate 5 and a control or distributor element 6.

The housing 1 has a substantially square cross-section and has a housing bottom 7 with four housing walls 8 attached thereto, on the free ends of which a housing cover 9 is detachably mounted.

The drive shaft 2 projects through a through-bore in the housing bottom 7 into the interior of the housing 1 and is rotatably mounted in this through-bore by means of a roller bearing 10 and in a blind bore in the housing cover 9 in a manner not shown. Inside the housing 1 the drive shaft 2 passes through respective central through-bores in the distributor element 6, the cylinder block 4 and the swashplate 5.

The distributor element 6 is attached to the housing cover 9 and is provided with two through openings in the form of kidney-shaped control slits 11 which are connected to respective suction or pressure connections (not shown) of the axial piston machine. The spherical control surface 12 of the distributor element 6 remote from the housing cover 9 serves at the same time as an axial bearing surface for the cylinder block 4.

The cylinder block 4 is connected non-rotatably to the drive-shaft 2 by means of a keyed-groove connection 13 and has axially parallel cylinder bores 14 which are arranged uniformly on a pitch circle coaxial to the drive shaft axis and open freely via passages 15 on the axial cylinder block bearing surface facing the distributor element 6. The passages 15 are arranged on the same pitch circle as the control slits 11. Pistons 16 guided axially displaceably within the cylinder bores 14 are provided at their ends facing the housing bottom 7 with spherical heads 17 which are mounted in slippers 18 through which they bear on a working surface 19 of the swashplate 5, which is supported on the housing bottom 7. Passages 38, which extend axially through the pistons 16 and the slippers 18 but are only indicated in the latter, supply the sliding surfaces between the spherical heads 17 and the slippers 18 as well as the path of the latter on the swashplate working surface 19 with lubricating oil.

A pressure spring 20 on the cylinder block 4 supported within its through-passage and surrounding the drive shaft 2 presses, via press pins 21, a pressure head 22 and an annular pressure plate 23 against the slippers 18 and thus holds these up against the working surface 19 of the swashplate 5. The pressure head 22, shaped as a sector of a sphere, is fastened to a sleeve-like extension of the cylinder block 4 and has the drive shaft 2 going through it. The pressure plate 23 is movably mounted with its inner rim on the outer surface of the pressure head 22. It has bores 24 that surround free end sections of the slippers 18, and rests on projections 25 of the slippers.

The swashplate 5 is supported by swivel bearing means on the housing bottom 7 eccentrically of the drive shaft axis 3, i.e. offset to the left relative to it as shown in the drawing, so that it can tilt about an effective tilt axis 26. The swivel bearing means comprises two pivot hemispheres 27 and two half-shells 28 mounted thereon that are formed in opposed rim regions of the rear side of the swashplate, i.e. the opposite side to the swashplate working surface 19. The effective tilt axis 26 is defined by the two centre points of the pivot hemispheres 27. These pivot hemispheres 27 are guided displaceably in respective radial guides 29 (only indicated in outline in the drawing) in the housing bottom 7 that extend radially relative to the drive shaft 2 and perpendicular to the effective tilt axis 26. In the non-tilted or zero position of the swashplate 5 its working surface 19 extends, as shown in FIG. 1, radially of the drive shaft axis 3. Furthermore, as can be seen in FIG. 1, the central through-bore 30 in the swashplate 5 is arranged eccentrically of the drive shaft axis 3, i.e. in FIG. 1 it is displaced to the right. The central through-bore 30 is substantially elliptical in shape, with its larger diameter extending perpendicularly to the effective tilt axis 26, making it possible to tilt the swashplate 5 into the maximum tilt position shown in FIG. 2.

An adjusting means 31 in the form of a rod that can be displaced towards the housing bottom 7 by a drive (not shown) is mounted in a nose on the side of the swashplate 5.

Figure 4:
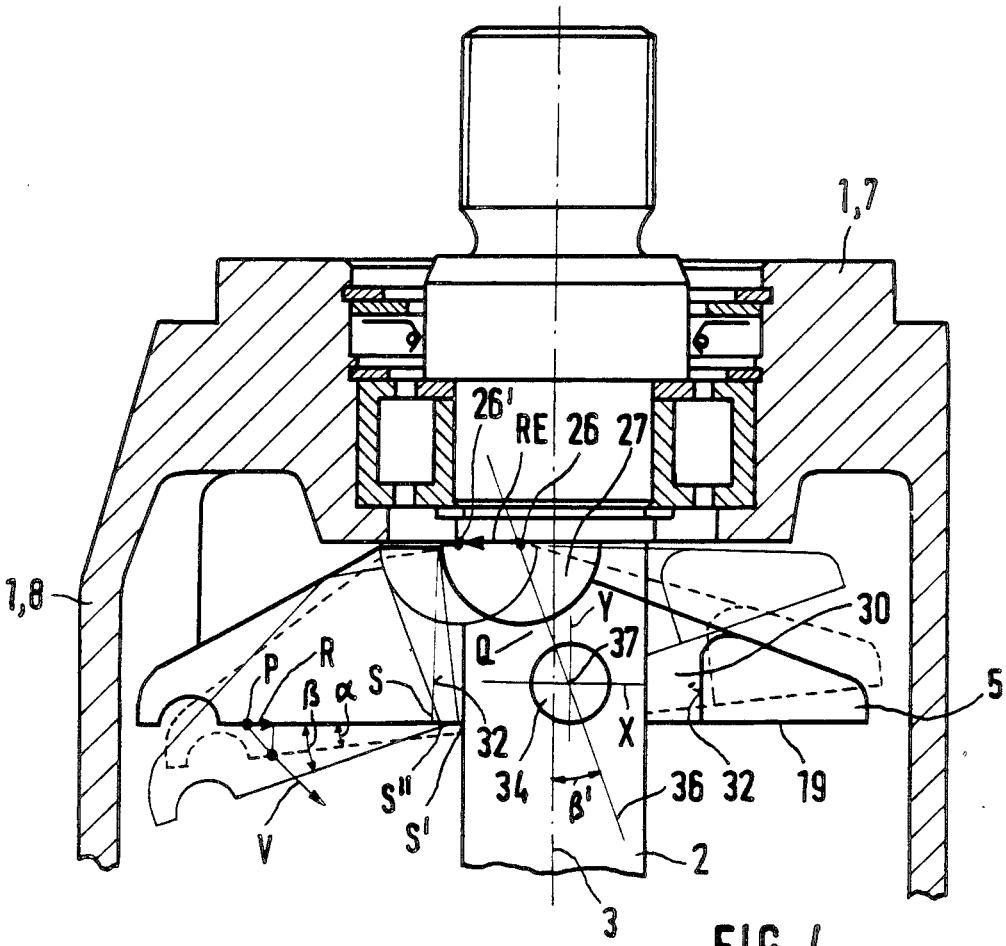
FIG. 4 is a schematic representation of the swashplate in the zero position and in the completely tilted-out position according to the invention, and of the maximum tilt position of the swashplate obtainable without using the solution of the invention
Figure 5:
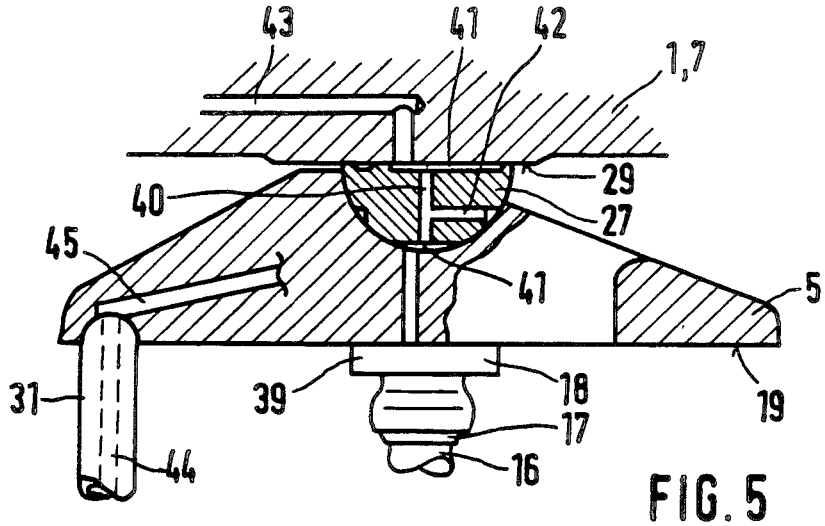
FIG. 5 is a schematic representation of the supply of lubricating oil to the swashplate.

As shown schematically in FIG. 4, when the swashplate 5 is tilted as indicated by an arrow V about the effective tilt axis 26 the swashplate working surface 19 or a point P thereon has a radial component of motion R which displaces the swashplate working surface 19 in FIG. 4 laterally to the right until the point S thereon, at which the larger diameter of the central through-bore 30 intersects its inner rim 32, reaches the position S' on the drive shaft 2 and thus prevents the swashplate 5 from tilting beyond the tilt angle $\alpha$ attained.

However, to enable the swashplate 5 to be tilted further to the tilt angle $\beta$ in FIG. 4, restraining guide means are provided which, when the swashplate is tilted, force the effective axis 26 to move by an amount RE radially relative to the drive shaft 2 in the direction opposite to that of the radial component of motion R of the swashplate working surface 19. For this purpose two parallel restraining guideways 33 are formed in the housing walls 8 intersected by the effective tilt axis 26, in which the swashplate 5 is rotatably guided by respective journals 34 extending parallel to the effective tilt axis 26 in respective sliding blocks 35.

In FIG. 4 the journals 34 are on the right-hand side of the drive shaft axis 3 in both the non-tilted and completely tilted-out positions of the swashplate 5. The restraining guideways 33 are inclined to the drive shaft axis 3 at a guidance angle $\beta'$ so that their central longitudinal axes 36 extend into the fourth quadrant Q of an imaginary x-y coordinate system of which the origin of the coordinates lies on the axis of rotation 37 of the journals 34 and the y-axis runs parallel to the drive shaft axis 3. The effective tilt axis 26 is in the fourth quadrant Q. When the swashplate 5 is not tilted out the longitudinal central axes 36 of the guideways 33 run in the direction of the effective tilt axis 26. As shown in FIG. 4, the guidance angle $\beta'$ of the guideways 33 is equal to the tilt angle $\beta$ of the completely tilted out swashplate 5. Alternatively the guideways 33 can run parallel to or inclined in other directions relative to, the drive shaft axis 3, for example towards the first quadrant, in which case the radial displacement path of the effective tilt axis 33 may be limited depending on the magnitude of the guidance angle $\beta'$.

Like the pivot hemispheres 27 in the guides 29 the spherical heads 17 are hydrostatically supported in the slippers 18, and the slippers 18 on the working surface 19 of the swashplate 5. The lubricating oil required for the hydrostatic support is supplied in a first embodiment from the cylinder bores 14 through axial bores 38 in the pistons 16, the spherical heads 17 and the slippers 18 (only shown in the latter). Lubricating oil is intermittently supplied to the pivot hemispheres 27 from the slippers by respective through-bores 39 through the swashplate 5 and connecting through-passages 40 in the pivot hemispheres 27 that each connect a groove 41 in the spherical surface with a groove 31 in the sliding surface of the respective pivot hemisphere 27. Transverse passages 42 branching from the through-passages 40 lead into further grooves in the spherical surfaces of the pivot hemispheres 27.

Instead of supplying lubricating oil from the cylinder bores 14, according to a second embodiment the lubricating oil can be supplied to the pivot hemispheres 27 via lubricating oil lines 43 leading to the guides 29 and thus to the grooves 41 in the sliding surfaces of the pivot hemispheres 27. According to a third embodiment the lubricating oil can be supplied through a longitudinal bore 44 in the adjusting means 31 and transverse bores 45 through the swashplate 5 connected thereto. The transverse bores 45 lead into the grooves 41 in the spherical surfaces of the pivot hemispheres 27.

The axial piston machine according to the invention can be operated in known manner both as a motor and as a pump. Its operation will now be explained only with reference to the radial adjustment of the effective tilt axis according to the invention.

Figure 2:
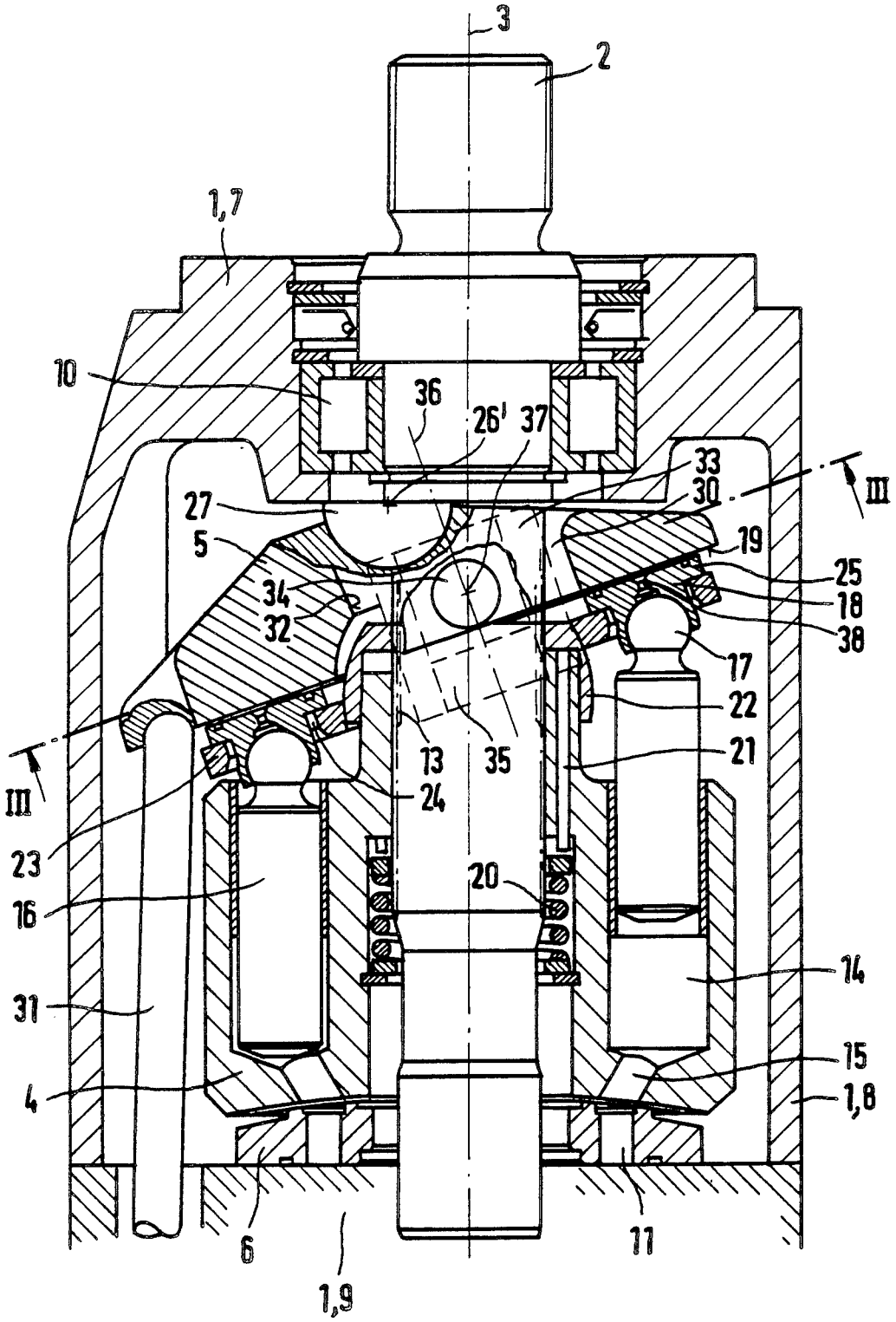
FIG. 2 is a longitudinal section through the axial piston machine shown in FIG. 1 with the swashplate completely tilted-out.
Figure 3:
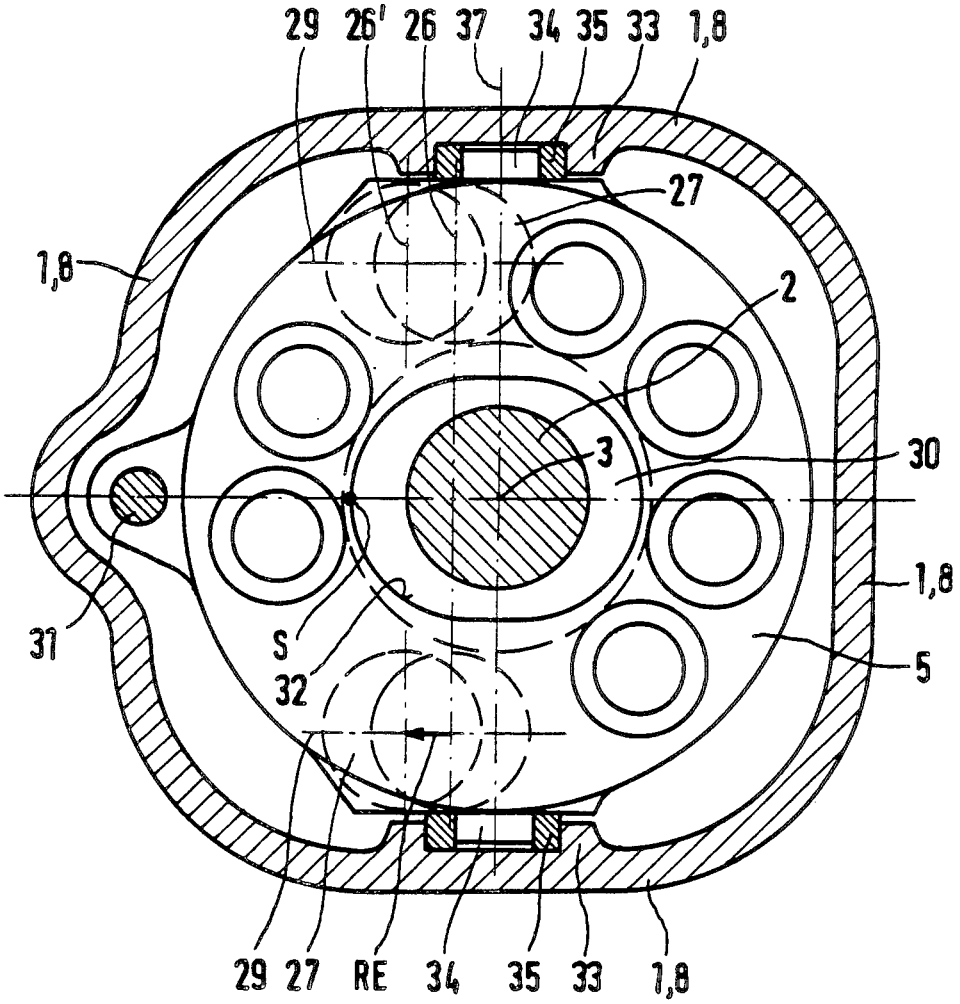
FIG. 3 is a section along the line III—III in FIG. 2.

Because the drive shaft axis 3 passing through the center of the pitch circle of the cylinder bores 14 is off-center the swashplate 5 is acted on more strongly on its right-hand side in FIG. 1 than on its left-hand side by the pistons 16 acted on by the oil pressure and the force of the pressure spring 20, and in this way is held in the completely tilted position shown in FIG. 2. The adjustment of the axial piston pump to reduced displacement, up to the zero position shown in FIG. 1, is done by forcibly urging the adjusting means 31 towards the housing bottom 7. If, starting from this zero position, the force on the adjusting means 31 is reduced the swashplate 5 tilts about the effective tilt axis 26 counterclockwise, as indicated in FIG. 4 by the arrow V. During this tilting movement the restraining guideways 33 exert on the pivot hemispheres, via the swashplate 5, a radial component of force directed to the left in FIG. 4 thus imparting to these and the effective tilt axis 26 a movement RE along the guides 29 in a direction opposite to that of the radial component of motion R of the swashplate working surface 19. This superimposes an opposing radial movement on the radial movement of the point S on the swashplate inner rim 32 towards the drive shaft 2 as the swashplate is tilted, so that the movement of this point S towards the drive shaft 2 is reduced and the swashplate 5 can accordingly be tilted until it reaches the tilt angle $\beta$. In this tilt position the point S is in the position S'' and the effective tilt axis 26 is in the position 26'. When tilting the swashplate 5 towards the zero position the effective tilt axis 26 is displaced to the right in FIG. 4 back towards the original position.

What is claimed is:

1. An axial piston machine of the swashplate type, comprising:

a housing;

a cylinder block rotatably supported inside the housing, and defining a plurality of cylinder bores;

a plurality of pistons supported for axial reciprocating movement in the cylinder bores;

an axially extending drive shaft connected to the cylinder block to rotate the cylinder block and the pistons;

a swashplate disposed inside the housing and including a working surface to reciprocate the pistons in the cylinder bores as the cylinder block and the pistons rotate;

bearing means located inside the housing, between the housing and the swashplate, defining a tilt axis, and supporting the swashplate for tilting movement about said tilt axis, wherein as the swashplate is tilted, the working surface of the swashplate has a radial component of motion relative to the drive shaft, and said bearing means is supported inside the housing for sliding movement toward and away from the drive shaft; and guide means located inside the housing and guiding the bearing means toward and away from the drive shaft, in a direction opposite to the direction of said radial component of motion of the working surface, as the swashplate tilts about the tilt axis.

2. An axial piston machine according to claim 1, wherein the bearing means is supported for said sliding movement with tilting movement of the swashplate.

3. An axial piston machine according to claim 2, wherein the swash plate engages the bearing means, and tilting movement of the swashplate causes said sliding movement of the bearing means.

4. An axial piston machine according to claim 1, wherein the bearing means includes swivel bearing means, and the guide means is disposed on the housing and extends in a direction toward and away from the drive shaft.

5. An axial piston machine according to claim 4, wherein the guide means comprises two spaced apart, opposed guideways and the swivel bearing means comprises two pivot hemispheres one guided in each of the respective guideways, and two half-shells formed on the swashplate and mounted on said hemispheres.

6. An axial piston machine according to claim 1, wherein the swashplate is rotatably guided by two journals parallel to the tilt axis that can rotate in two restraining guideways formed on opposing housing parts and running in respective planes perpendicular to the tilt axis, and which extend so that when tilting the swashplate they impart to the swivel bearing means a movement along the guide means in the direction opposite to the direction of the radial component of motion of the swashplate working surface.

7. An axial piston machine according to claim 6, wherein the drive shaft defines a drive shaft axis;

said two journals are supported for rotation about a journal axis, and when the swashplate is in a zero position, the journal axis intersects the drive shaft axis.

8. An axial piston machine according to claim 6, wherein the drive shaft defines a drive shaft axis; and the restraining guideways extend parallel to the drive shaft axis.

9. An axial piston machine according to claim 6, wherein the drive shaft defines a drive shaft axis;

said two journals are supported for rotation about a journal axis; and when the swashplate is in a zero position, the journal axis is located to one side of the drive shaft axis.

10. An axial piston machine according to claim 6, wherein the drive shaft defines a drive shaft axis;

said two journals are supported for rotation about a journal axis; and the restraining guideways are inclined at a guidance angle to the drive shaft axis.

11. An axial piston machine according to claim 10, wherein the guidance angle is substantially equal to the tile angle of the swashplate when the swashplate is in a completely tilted-out position.

12. An axial piston machine according to claim 6, wherein the restraining extend in the direction of the tilt axis when the swashplate is in a zero position.

13. An axial piston machine according to claim 6, wherein the drive shaft defines a drive shaft axis; and when the swashplate is in a zero position, the tilt axis is located to one side of the drive shaft axis.

14. An axial piston machine according to claim 6, wherein each restraining guideway in which a respective journal is mounted includes a sliding block guided therein.

15. An axial piston machine according to claim 1, wherein the tilt axis is spaced from the working surface of the swashplate.

16. An axial piston machine according to claim 15, wherein the drive shaft defines a drive shaft axis; and when the swashplate is in a zero position, the tilt axis intersects the drive shaft axis.

17. An axial piston machine according to claim 4, wherein the swivel bearing means is guided in said guide means with hydrostatic support.

18. An axial piston machine according to claim 17, wherein the guide means comprises two spaced apart, opposed guideways and the swivel bearing arrangement comprises two pivot hemispheres one guided in each of the respective guideways, and two half-shells formed on the swashplate mounted on said semi-hemispheres and for hydrostatic support in the guideways the pivot hemispheres have flat surfaces in the form of slipper sliding surfaces.

19. An axial piston machine according to claim 18, wherein each pivot hemisphere includes at least one through-passage connecting a groove made in its flat sliding surface with a groove made in its spherical sliding surface.

20. An axial piston machine according to claim 19, wherein each pivot hemisphere has at least one transverse passage which connects the through-passage with a further groove in the spherical sliding surface of the respective pivot hemisphere.

21. An axial piston machine according to claim 19, which includes a lubricating oil line in the housing leading into each respective guideway for supplying lubricating oil to the grooves in the flat sliding surface of the pivot hemispheres.

22. An axial piston machine according to claim 19, which includes swashplate adjusting means having a longitudinal bore therein for supplying lubricating oil to transverse bores in the swashplate which lead into the respective grooves in the spherical sliding surfaces of the pivot hemispheres.

23. An axial piston machine according to claim 19, wherein, for supplying lubricating oil intermittently from the cylinder bores, respective axial bores are formed through the pistons, the spherical heads and the slippers, and respective through-bores are formed in the swashplate leading to the pivot hemispheres which lead at one end into the half-shells in the region of the grooves and at the other end to the swashplate working surface on its slipper path.

* * * * *

UNITED STATES PATENT AND TRADEMARK OFFICE

CERTIFICATE OF CORRECTION

PATENT NO. : 5,095,807

DATED : March 17, 1992

INVENTOR(S) : Ludwig Wagenseil

It is certified that error appears in the above-identified patent and that said Letters Patent is hereby corrected as shown below:

Column 8, line 4, Claim 12: "restraining extend" should read as --restraining guideways extend--

Signed and Sealed this

Seventeenth Day of August, 1993

*Attest:*

*Attesting Officer*

BRUCE LEHMAN

*Commissioner of Patents and Trademarks*